US011773792B1

(12) United States Patent
Coldren et al.

(10) Patent No.: US 11,773,792 B1
(45) Date of Patent: Oct. 3, 2023

(54) MULTI-FUEL INJECTION SYSTEM AND INJECTOR

(71) Applicant: Caterpillar Inc., Peoria, IL (US)

(72) Inventors: Dana R. Coldren, Secor, IL (US); Eric L. Schroeder, Germantown Hills, IL (US); Robert Graumueller, Kiel (DE); Andrew O. Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/073,430

(22) Filed: Dec. 1, 2022

(51) Int. Cl.
*F02D 19/06* (2006.01)
*F02D 41/38* (2006.01)

(52) U.S. Cl.
CPC ..... *F02D 19/0694* (2013.01); *F02D 41/38* (2013.01)

(58) Field of Classification Search
CPC .... F02M 21/00; F02M 21/02; F02M 21/0203; F02M 21/0206; F02M 21/0209; F02M 21/0212; F02M 21/0215; F02M 21/0218; F02M 21/0248; F02M 21/0251; F02M 21/0254; F02M 21/0257; F02M 21/026; F02M 21/0263; F02M 2200/44; F02M 61/18; F02M 61/1893; F02B 43/00; F02B 2043/103; F02D 19/06; F02D 19/08; F02D 41/0027
See application file for complete search history.

(56) References Cited

U.S. PATENT DOCUMENTS

| | | | | |
|---|---|---|---|---|
| 7,707,993 | B2 | 5/2010 | Coldren et al. | |
| 9,234,452 | B2 | 1/2016 | Stockner | |
| 10,184,440 | B2 | 1/2019 | Caley | |
| 10,371,065 | B2 | 8/2019 | Mumford et al. | |
| 11,480,115 | B1 * | 10/2022 | Svensson | F02M 35/10157 |
| 11,639,698 | B1 * | 5/2023 | Schroeder | F02D 19/081 123/305 |
| 2013/0319373 | A1 * | 12/2013 | Brown | F02M 21/0248 123/456 |
| 2014/0034023 | A1 * | 2/2014 | Coldren | F02M 21/0257 123/472 |
| 2014/0123936 | A1 * | 5/2014 | Kim | F02M 63/0035 123/456 |
| 2016/0123286 | A1 * | 5/2016 | Hou | F02M 45/086 123/304 |
| 2017/0016434 | A1 * | 1/2017 | Steffen | F04B 53/04 |

FOREIGN PATENT DOCUMENTS

| | | |
|---|---|---|
| CN | 105114193 A | 12/2015 |
| CN | 111720244 A | 9/2020 |

* cited by examiner

*Primary Examiner* — John Kwon
(74) *Attorney, Agent, or Firm* — Bookoff McAndrews, PLLC

(57) ABSTRACT

A multi-fuel injector includes a primary fuel inlet configured to receive a liquid primary fuel, a pilot fuel inlet configured to receive a liquid pilot fuel that is a different fuel than the primary fuel, and a spill valve in fluid communication with the primary fuel inlet. The fuel injector also includes a control valve configured to control a pressure of fluid within a hydraulic control chamber, and an injection valve abutting the hydraulic control chamber, the injection valve being configured to move to an injection position to inject both the primary fuel and the pilot fuel.

20 Claims, 3 Drawing Sheets

MULTI-FUEL INJECTION SYSTEM AND INJECTOR

TECHNICAL FIELD

The present disclosure relates generally to methods and systems for internal combustion engine components and, more particularly, to a fuel injector configured to inject two different fuels.

BACKGROUND

Internal combustion engine technology has seen continual improvements, these improvement benefitting efficiency, emissions, and power output. While improvement(s) to conventional engines enabled the use of these engines in many applications and environments, there is also interest in the use of so-called "alternative fuels." These fuels can be used as an alternative to conventional fuels such as diesel fuel and/or gasoline, and can have advantages such as renewability and reduced generation of greenhouse gases when combusted. While some engine systems can operate solely on an alternative fuel, these systems frequently encounter inefficiencies and other issues due to, for example, reduced energy density of the alternative fuel, slower vaporization time of the alternative fuel, lower cetane number of the alternative fuel, among other potential issues.

To address these drawbacks, some internal combustion engines are designed to inject two fuels, a pilot fuel that, when combusted, generates a pilot flame, and an alternative fuel which combusts in a more complete and predictable manner when ignited with the pilot flame. While multi-fuel internal combustion engines can improve combustion, they tend to require increasingly complex fuel injectors. For example, some engines are equipped with two sets of fuel injectors, or fuel injectors with multiple individually-actuated injector tips. These relatively complex designs introduce additional failure points and can inject fuel less accurately as compared to single-tipped injectors.

An exemplary fuel injector is described in U.S. Pat. No. 10,184,440 B2 ("the '440 patent") to Caley. The fuel delivery system described in the '440 patent can accommodate liquid fuels including gasoline and/or ethanol. The fuel delivery system of the '440 patent can also use a gaseous fuel, such as natural gas, in addition to the liquid fuel. The pressure of the supplied gaseous fuel can be used to delivery this fuel at the desired rate, and can be provided at low pressure to assist the delivery of liquid fuel. While the fuel delivery system described in the '440 patent may be useful for supplying both a liquid fuel and a gaseous fuel with a single system, the '440 patent does not describe two different liquid fuels being injected in a single injection event.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a multi-fuel injector may include a primary fuel inlet configured to receive a liquid primary fuel, a pilot fuel inlet configured to receive a liquid pilot fuel that is a different fuel than the primary fuel, and a spill valve in fluid communication with the primary fuel inlet. The fuel injector may also include a control valve configured to control a pressure of fluid within a hydraulic control chamber, and an injection valve abutting the hydraulic control chamber, the injection valve being configured to move to an injection position to inject both the primary fuel and the pilot fuel.

In another aspect, a fuel injection system may include a fuel injector configured to inject multiple liquid fuels from a single injection nozzle, a fuel supply system configured to supply a first fuel at a first pressure and a second fuel at a second pressure, and an electronic control module. The electronic control module may be configured to set the first pressure, set the second pressure, and adjust at least one of the first pressure or the second pressure to change a quantity of the first fuel injected by the injection nozzle.

In yet another aspect, a fuel injection method may include setting a first pressure for a first liquid fuel, setting a second pressure for a second liquid fuel, the first liquid fuel being different than the second liquid fuel, and supplying the first liquid fuel to a fuel injector at the first pressure. The method may also include supplying the second liquid fuel to the fuel injector at the second pressure, injecting the first liquid fuel and the second liquid fuel in a first injection, and adjusting at least one of the first pressure and the second pressure to modify a quantity of first liquid fuel injected in a second injection.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. As used herein, "lower" refers to the distal direction of the fuel injector, the distal end of the fuel injector including or being located closest to the injection orifice(s). Thus, the words "upper" and "proximal" may be considered interchangeable, and the words "lower" and "distal" may be considered interchangeable.

Figure 1B:
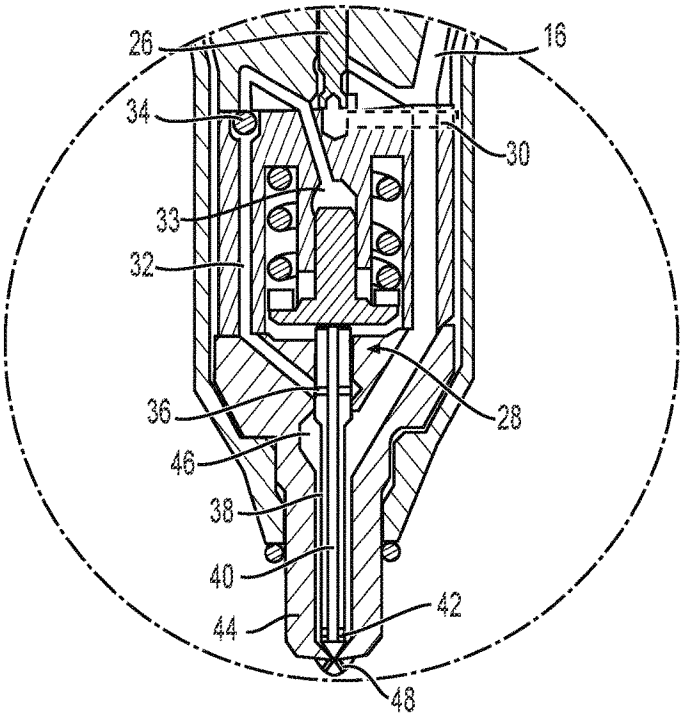
FIG. 1B is an enlarged cross-sectional view of the tip of the fuel injector of FIG. 1A.
Figure 1A:
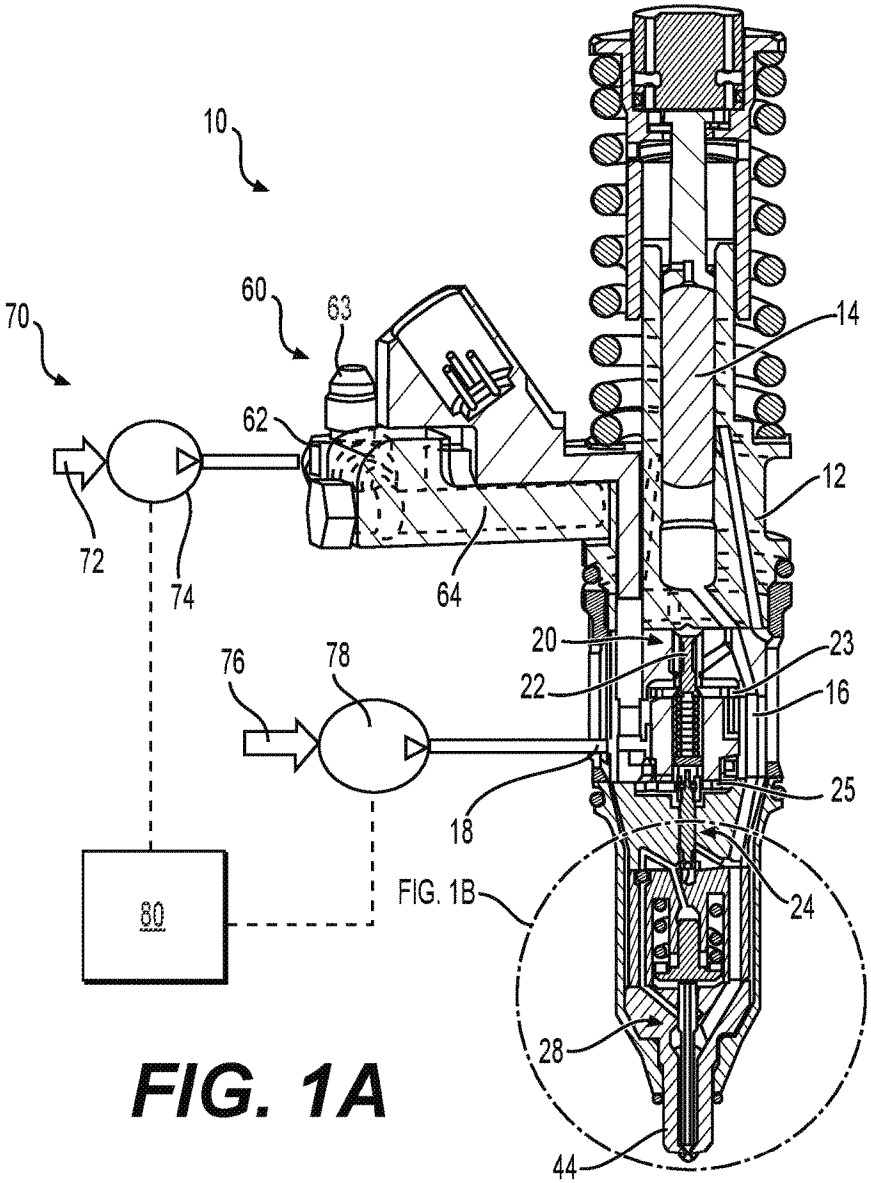
FIG. 1A is a schematic cross-sectional view of a multi-fuel injection system including a fuel injector, according to aspects of the disclosure.

FIG. 1A illustrates an exemplary multi-fuel injection system 10 according to aspects of the present disclosure. Fuel injection system 10 may include a plurality of fuel injectors 12, a fuel supply system 70 configured to supply two different types of liquid fuels to each injector 12 at controllable pressures, and at least one electronic control module (ECM) 80 configured to independently control the supply pressures of the liquid fuels and the valves of injector 12. Injector 12 may include a pair of fuel connections 60 (one shown in FIG. 1A) forming respective inlets and outlets for supply of a primary fuel. Injector 12 may also include a pilot fuel or secondary fuel inlet 18 connected to fuel supply system 70.

As used herein a "primary" fuel refers to a fuel that, under steady state operating conditions of the internal combustion engine, is injected at a volume that is 50% or more of the total volume of fuel injected into a particular combustion chamber of the engine during an injection event that includes a pilot injection (e.g., of diesel fuel) and a main injection (e.g., of methanol). A "pilot" fuel may refer to a fuel that is mostly or entirely injected before the primary fuel in an injection event. Additionally, while the terms "pilot fuel" and "primary fuel" correlate to the orders in which these different fuels are injected, as understood, the pilot injection and primary injection may occur continuously, and may include the injection of a mixture of the two fuels for a period of time, in contrast to some injection methods in which the pilot and main injections are separated by a period of time during which no fuel is injected.

Fuel supply system 70 may be considered a "low-pressure" supply system for the primary fuel because, while the pressure of fuel to injector 12 may be adjustable upward and downward, this pressure remains below the pressure of fuel within injector 12 during an injection event. The relatively higher pressures of primary fuel supplied via fuel supply system 70 may be achieved via compression with plunger 14, as described below.

Fuel injector 12 may be a mechanically-actuated electronically-controlled unit injector having a spill valve 20, a control valve 24 that is also configured to act as a pilot fuel fill valve, and an injection valve 28 having a hollow interior to facilitate injection of pilot fuel. Injector 12 may include a cam-driven plunger 14, a pressurized fuel passage 16 for primary fuel downstream of plunger 14, and a nozzle 44 forming a distal end portion of injector 12 that is configured to inject both the pilot fuel and the primary fuel in a single injection event.

Fuel injector 12 may be configured to receive primary liquid fuel with a primary fuel connection 60. Injector 12 may receive pilot fuel, also referred to herein as a secondary fuel, with a pilot fuel inlet or pilot fuel connection 18. As used herein, whether a fuel is "liquid" or "gaseous" is determined based on the state of the fuel as it is delivered to the fuel injector. For example, liquid methanol may be supplied as the primary liquid fuel, while liquid diesel may be supplied as the pilot fuel. In contrast, a fuel delivered to a fuel injector as a gas can be considered as a gaseous fuel, even if the gaseous fuel is stored in a liquid state.

A pair of separate fuel paths may be formed within fuel injector 12 such that the two fuel paths are isolated from each other, except at nozzle 44 where both fuels may be present at the same time. A fuel path for primary fuel may include a primary fuel connection 60, a chamber below plunger 14 in communication with connection 60, fuel passage 16, and a nozzle chamber 46 (FIG. 1B). This fuel path may also include spill valve 20 such that spill valve 20 is configured to facilitate pressurization of the primary fuel within injector 12, and facilitate draining of this fuel when pressurization is not desired. For example, a path for draining primary fuel from injector 12 may include spill valve 20 and a primary fuel outlet connection 61 (primary fuel inlet connection 60 shown in FIG. 1A, primary fuel outlet connection 61 shown in FIG. 2).

A fuel path for pilot fuel within injector 12 may include pilot fuel supply connection 18, and as shown in FIG. 1B, a low-pressure passage 30, an injection valve fill passage 32, a control chamber 33, and an injection valve passage 40 formed within a hollow interior of an injection valve 28 that includes pilot fuel passage 36 and pilot fuel openings 42. A pilot fuel outlet connection may be connected radially-opposite of connection 18 to connect injector 12 to downstream components of the pilot fuel portion of fuel supply system 70.

Spill valve 20 may be a normally-open valve including a valve member 22 that is movable between an open position and a closed position. A spring member may act to bias spill valve member 22 to the open position. When the valve member 22 is in the open position, fuel passage 16 may be connected to a low-pressure fuel drain, such as a primary fuel connection 60 forming an outlet, as described below. When in the closed position, spill valve 20 may prevent the primary fuel from exiting injector 12 via this fuel connection 60, enabling pressurization of this fuel via plunger 14. Spill valve 20 may be actuated via a spill valve solenoid that actuates a spill valve armature 23 fixed to spill valve member 22.

Control valve 24 may be a second electronically-controlled valve. With reference to FIG. 1B, control valve 24 may include a control valve member 26 having a non-injection position and an injection position. Control valve member 26 may be configured to connect a low-pressure fuel passage 30 with control chamber 33 when in the injection position, and block the connection between low-pressure fuel passage 30 and control chamber 33 when in the non-injection position. Control valve 24 may also be configured to control the introduction of pilot fuel into injection valve 28. For example, when in the injection position, control chamber 33 is connected to a low-pressure pilot fuel supply, providing pilot fuel to injection valve 28, as described below.

Injection valve 28 may be a one-way valve formed with an injection valve member 38, a spring biasing the injection valve member to the non-injection position, and a hydraulic control chamber 33 at a proximal end of valve member 38. Injection valve member 38 may rest in the non-injection position to close orifices 48 of nozzle 44. The injection position may be an open position which opens orifices 48 and allows injection of fuel present in nozzle chamber 46.

Valve member 38 may have a needle-like shape that extends from a proximal end abutting control chamber 33 to a distal tip end that opens and closes orifices 48. Injection valve member 38 may have a hollow interior that defines injection valve passage 40. Injection valve passage 40 may be configured to store a quantity of pilot fuel. The hollow interior may extend from a central portion of member 38 that abuts injection valve fill passage 32 to the distal end of member 38 within nozzle chamber 46. The proximal portion of passage 40 may include one or more radial connecting passages 36 in a central portion of injection valve passage 40 that are in fluid communication with injection valve fill passage 32. Injection valve passage 40 may include radially-extending pilot fuel openings 42 at or near the distal end of valve member 38. These pilot fuel openings 42 may open into nozzle chamber 46 within nozzle 44.

Fill passage 32 may include, if desired, a one-way valve 34 that allows flow of fluid from control chamber 33 to pilot fuel passage 36, but prevents this fuel from returning to control chamber 33 via injection valve fill passage 32. Valve 34 may be a spring-biased valve, the spring not being shown in the figures.

ECM 80 may be an electronic engine control module that is programmed to control one or more aspects of system 10, including independent control of the pressure of each fuel supplied with fuel supply system 70. ECM 80 may also electronically control fuel injection via injectors 12. ECM 80 may encompass a single control unit that controls both fuel supply system 70 and injectors 12, or separate control modules, such as one or more modules 80 that control fuel supply system 70 and one or more additional modules 80 that control injectors 12. ECM 80 may be enabled, via programming, to generate commands that set and adjust the pressure of primary and pilot fuels supplied in liquid form via fuel supply system 70, and commands that control fuel injection events. In particular, ECM 80 may be configured, via programming, to determine a desired pressure difference between the primary and pilot fuel provided to injector 12, the pressure being set with pressure pump 74 and pressure pump 78. ECM 80 may be configured to adjust the pressure difference between the primary fuel (e.g., methanol) and the pilot fuel (e.g., diesel fuel) based on sensed or calculated (e.g., estimated) conditions of the internal combustion engine, such as an intake manifold temperature, one or more signals indicative of a cold start condition of system 10 (e.g., oil temperature sensors or other temperature sensors), desired power, intake manifold pressure, and/or engine speed. The pressure difference between the primary and pilot fuels may be adjusted by controlling one or more fuel pumps and/or pressure regulating valves upstream of injector 12. ECM 80 may further be configured to control the amount of pilot fuel that is metered into injection valve member 38 by controlling actuation of control valve 24. For example, ECM 80 may generate commands for energizing a solenoid for valve 24 during a period of time when the spill valve 20 is open, allowing fuel to enter injection valve passage 40 prior to a future fuel injection event.

ECM 80 may embody a single microprocessor or multiple microprocessors that receive inputs and generate outputs. ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the functions described with respect to method 400, described below. Numerous commercially available microprocessors can be configured to perform the functions of ECM 80. Various other known circuits may be associated with ECM 80, including current monitoring circuitry, signal-conditioning circuitry, communication circuitry, and other appropriate circuitry.

As indicated above, system 10 may include a fuel supply system 70 in addition to injector 12. Fuel supply system 70 may include a series of fuel routing passages that connect a plurality of injectors 12 to a primary fuel source 72 and to a pilot fuel source 76. One or more components, such as pressure pump 74, pressure regulation valves, etc., may be connected to injector 12 via one or more fittings 62. Pressure pump 74 and/or other components of fuel supply system 70 may be in communication with ECM 80 such that ECM 80 issues commands for controlling aspects of fuel supply system 70, dashed lines in FIG. 1A representing electric communication between ECM 80 and fuel supply system 70. This communication may enable ECM 80 to set and adjust the supply pressure of the primary fuel. One or more pressure pumps 78 and/or pressure regulation valves may be configured to supply pilot fuel to pilot fuel connection 18 at a pressure that is determined with ECM 80. If desired, one or more valves (notshown) controlled with ECM 80 may be configured to allow supply of pilot fuel to both pump 74 and pump 78 to enable a "limp-home" mode, as described below.

ECM 80 may be configured to determine when it is desirable to operate the engine with a greater or lesser amount of pilot fuel. For example, ECM 80 may monitor one or more signals associated with conditions of system 10, including whether the engine is in a cold start condition. This may be determined for a period of time following an initial startup of the engine, for example, a predetermined period of time following a request to operate the engine (e.g., in response to a "start" switch). ECM 80 may also monitor temperatures of system 10, such as an intake manifold air temperature (IMAT). When the value of IMAT is below a predetermined threshold, or based on a lookup table or map, ECM 80 may determine that a greater amount of pilot fuel is desirable, and may cause a corresponding increase in pilot fuel pressure. Additionally, ECM 80 may determine that a greater amount of pilot (e.g., diesel) fuel is necessary when the engine is in a cold start condition. ECM 80 may generate commands that result in a greater difference between the pilot fuel pressure and primary fuel pressure, at increasing engine speeds, which may allow fuel to be introduced more quickly into nozzle 44. Finally, ECM 80 may be configured to operate an injector 12 solely with the pilot fuel, based on a malfunction with the primary fuel supply system, a low quantity of primary fuel being present, or in response to a request from an operator. This operation may be referred to as a "limp-home" mode or reduced-power mode, as the output of the engine may be significantly reduced by operating solely on fuel supplied via passages within injection valve member 38.

Figure 2:
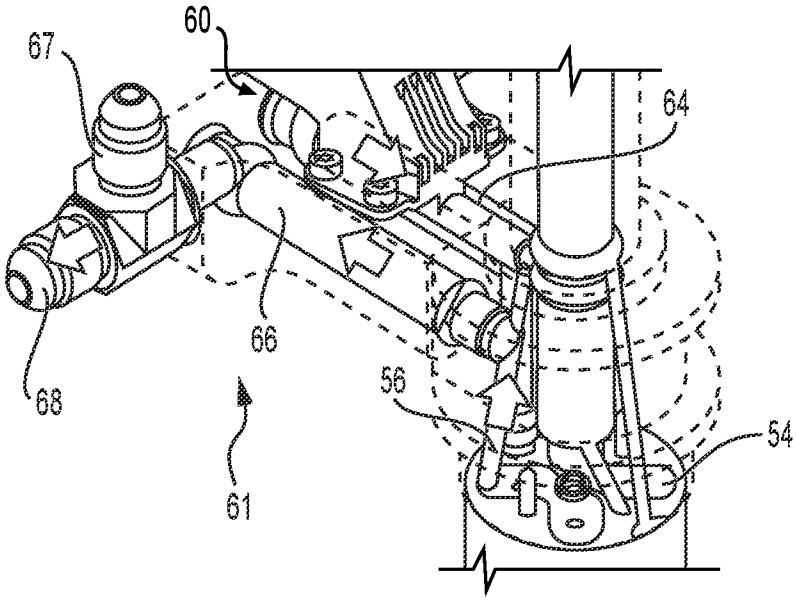
FIG. 2 is a perspective view showing a flow of fuel within the fuel injector of FIG. 1A.

Each primary fuel connection 60 may include one or more fittings that are connected to receive fuel from fuel supply system 70 or return fuel to fuel supply system 70, a primary fitting 62 and a secondary fitting, such as a bypass fitting 63 (FIG. 1A) or a secondary fitting 67 (FIG. 2). Each fitting 62 may be in communication with a bridging passage 64 that extends outward from a port in a sidewall of injector 12. Bridging passage 64 may be configured, in the example of an inlet passage, to guide primary fuel from one or more fittings 62 to an interior of injector 12. Bypass fitting 63 maybe connected to a passage for supplying fuel to fitting 62 of another injector 12 such that the fuel supplied to the downstream injector 12 is not impacted by pressures and/or flows of fuel within the upstream injectors 12.

Figure 3:
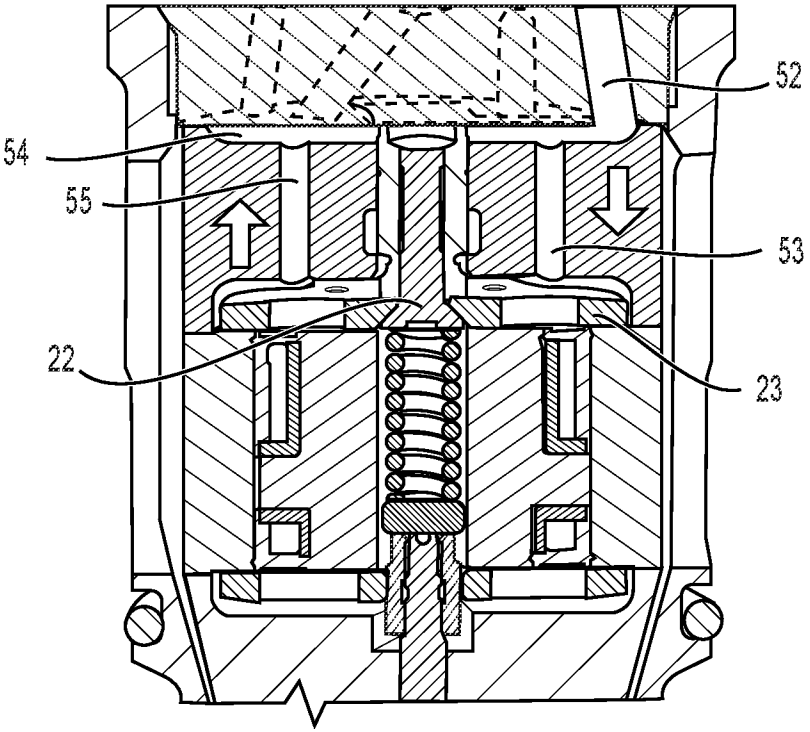
FIG. 3 is schematic cross-sectional view showing a flow of fuel within an alternate configuration of the fuel injector configuration of FIG. 1A.

FIGS. 2 and 3 illustrate an exemplary configuration of system 10 in which injector 12 is connected to a low-pressure fuel supply system 70. FIG. 2 shows fuel connections 60 and 61 useful in the configuration of FIG. 1, while FIG. 3 shows an exemplary alternate configuration for supplying fuel through a path within a chamber containing armature 23 connected to spill valve member 22. FIG. 2 shows inlet fuel connection 60 as well as outlet fuel connection 61 for removing primary fuel from injector 12. The structure of inlet fuel connection 60, positioned adjacent to outlet fuel connection 61, may be substantially identical to the inlet connection 60. Connection 60 may include a bridging passage 66 connected between a drain passage 56 within an interior of injector 12 and an outlet fitting 68.

In some aspects, primary fuel inlet and outlet connections 60 and 61 may be positioned above a cylinder head of the internal combustion engine in which injector 12 is installed. Thus, fuel passages of the primary fuel portion of fuel supply system 70 may extend, at least in part above the cylinder head in an area covered with a valve cover. In contrast, parts of the system for supplying pilot fuel, such as pilot fuel connection 18 (FIG. 1A), may be located within an interior of the cylinder head. Each fitting 62 and 68 may extend at an approximately 90-degree angle with respect to bridging passage 64 and bridging passage 66 to accommodate the geometry of the engine in which injector 12 is installed.

Each primary fuel connection 60 and 61 may include one or more secondary fittings, such as bypass fitting 63 in FIG. 1A or secondary fitting 67 in FIG. 2. Bypass fitting 63 and 67 may be useful for connecting a plurality of injectors 12 to primary fuel source 72, and one or more return lines for primary fuel source, respectively. For example, a first injector 12 may include one or more fittings 62 that is connected to primary fuel source 72, while bypass fitting 63 may be connected to a passage (not shown) to a second injector 12. Thus, fuel injectors 12 may be connected in parallel such that each fuel injector 12 receives fuel that is pressurized with pressure pump 74.

In the embodiment shown in FIG. 3, each respective bridging passage 64 may be connected to an interior of injector 12. For example, injector 12 may include a descending fuel passage 52 that connects to a fuel moat 54 at a proximal end of spill valve member 22. Spill valve member 22 may separate moat 54 of primary fuel into a plurality of different isolated sections. Fuel moat 54 may also be connected to a pair of connecting passages 53 and 55. Connecting passage 53 may connect fuel moat 54 to a cavity that contains spill valve armature 23, while connecting passage 55 may be connected downstream of connecting passages 53 extending away from spill valve armature 23. Fuel from connecting passage 53 may contact and surround armature 23 and, in some configurations, may act as cooling fluid for armature 23.

Spill valve member 22 may respond to commands from ECM 80 to allow or prohibit communication between connecting passage 53 and a passageway that allows fuel to drain from injector 12 via a cavity under plunger 14. Passages 53 and 55 may be in communication with each other, allowing fuel to flow in the directions indicated with arrows in FIG. 3, regardless of the position of spill valve member 22. When ECM 80 energizes a spill valve solenoid, spill valve member 22 may be secured in a closed position, this position being shown in FIG. 3. In this position, communication between connecting passage 53 and the cavity under plunger 14 may be blocked by spill valve member 22.

INDUSTRIAL APPLICABILITY

System 10 may be useful in any internal combustion engine that is capable of operating with multiple types of liquid fuel that are injected together. System 10 may be utilized for generating power in a stationary machine (e.g., a generator or other electricity-generating device), in a mobile machine (e.g., an earthmoving device, a hauling truck, a drilling machine, etc.), or in other applications in which it may be beneficial to operate an engine with a plurality of different fuels. System 10 may generate electrical power, motive power, and/or may provide power for operating one or more associated systems, such as hydraulic systems.

Injector 12 may receive fuel from primary fuel connection 60 and pilot fuel connection 18 prior to a fuel injection event. For example, primary fuel may enter injector 12 via one or more fittings 62 and bridging passage 64. The primary fuel may fill the chamber below plunger 14, as well as fuel passage 16 and nozzle chamber 46 for injection via orifices 48. Pilot fuel may enter injector 12 via pilot fuel connection 18, pilot fuel flowing to control chamber 33, injection valve fill passage 32, and injection valve passage 40 from pilot fuel passage 36. Pilot fuel may exit injection valve passage 40 via pilot fuel openings 42 and displace primary fuel within nozzle 44.

To inject fuel with system 10, spill valve 20 may be closed while a cam drives plunger 14 downward, pressurizing the primary fuel within injector 12 and preventing pressurized fuel from draining from injector 12. For example, spill valve member 22 may block the flow of primary fuel to bridging passage 66 (FIG. 2). At the same time or slightly before or after the actuation of spill valve 20, ECM 80 may cause control valve 24 to move from the resting non-injection position in which high-pressure fluid (e.g., high-pressure pilot fuel) is present within control chamber 33 to the injection position in which control chamber 33 is connected to a low-pressure fuel drain. This may enable injection of both the pilot fuel and the injection of the primary fuel in a single injection event.

In a first injection, ECM 80 may supply injector 12 with primary fuel at a first pressure and secondary or pilot fuel at a second pressure. In a second injection, ECM 80 may modify the first pressure and/or the second pressure. This pressure change may modify a difference between the two pressures, this pressure difference resulting in the introduction of a varying amount of pilot fuel within nozzle 44. This pilot fuel may be received within nozzle 44 from pilot fuel openings 42 of valve member 38.

Figure 4:
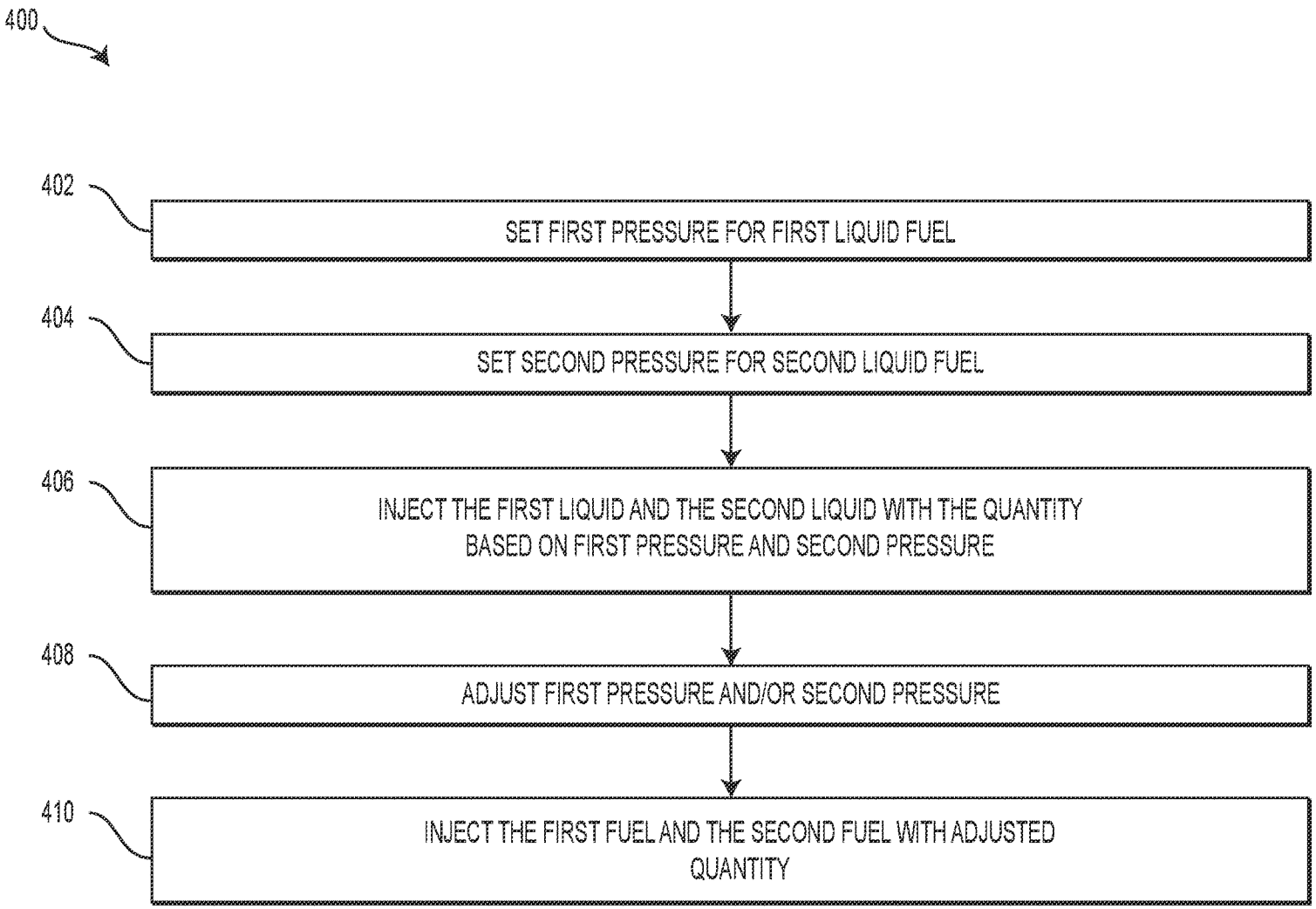
FIG. 4 is a flowchart depicting an exemplary fuel injection method.

FIG. 4 includes a flowchart representing a method 400 that may be performed during the operation of multi-fuel injection system 10 to adjust a ratio of pilot fuel and primary fuel injected via nozzle 44. For example, in a first injection, a first pressure of pilot fuel and a second pressure of primary fuel may be set with ECM 80 such that the first and second pressures have a desired pressure differential. The pressure differential may be used to set the quantity of pilot fuel injected with nozzle 44, as described below. Thus, method 400 may include adjusting a difference between the first and second pressures to modify injection quantities during the operation of system 10.

Method 400 may include a step 402 in which a first pressure for the first fuel is set with ECM 80. Step 402 may include, for example, generating command(s) with ECM 80 to cause pressure pump 74 and/or one or more pressure regulating valves associated with pressure pump 74 to supply the first fuel at a first pressure. A step 404 may include generating command(s) with ECM 80 to cause one or more pressure pumps 78 and/or pressure regulating valves to supply second fuel at a second pressure. The first fuel may be diesel fuel and the second fuel may be an alcohol-containing fuel such as methanol or ethanol. In some aspects, the first pressure may be higher than the second pressure. This may enable the first fuel to displace at least some of the second fuel within nozzle 44.

A step 406 may include injecting fuel with injector 12. For example, both the first fuel and the second fuel may be injected via orifices 48 of nozzle 44 when ECM 80 actuates spill valve 20 and control valve 24. The amount of primary fuel injected during this injection may be controlled based on the difference between the first pressure and the second pressure, as this pressure difference may influence the amount of pilot fuel, such as diesel fuel, present within nozzle 44. For example, when the pressure difference is relatively small, a corresponding small amount of diesel fuel may exit injection valve passage 40 via pilot fuel openings 42. This pilot fuel may displace some of the primary fuel present within nozzle chamber 46 of nozzle 44. When the pressure different is relatively large, a larger amount of diesel fuel may be present within nozzle chamber 46.

During fuel injection, all or approximately all of the pilot fuel present within nozzle 44 may be injected via orifices 48. This injection may occur before the injection of the primary fuel. When this pilot fuel is diesel fuel, the diesel fuel may combust via compression-based autoignition. Thereafter, the primary fuel may be injected by the same orifices 48, this primary fuel being ignited via flames generated with combustion of the pilot fuel.

A step 408 may include adjusting the first pressure and/or the second pressure. This may include generating one or more commands with ECM 80 that modify the pressure of fuel supplied to injector 12 via pressure pump 74 and one or more pressure pumps 78. For example, a pressure of pilot fuel may be increased to increase an amount of pilot fuel that is injected. Step 408 may also include actuating control valve 24 to refill injection valve passage 40 and nozzle chamber 46 with pilot fuel.

ECM 80 may determine that injection of an increased amount of pilot fuel is desired based on, for example, a determination that the internal combustion engine is in a cold start condition or when an intake manifold air temperature (IMAT) is relatively low. ECM 80 may determine that the engine is in a cold start condition when operating within a predetermined period of time following an initial request to operate the engine. Additionally or alternatively, ECM 80 may determine that the engine is in a cold start condition based on oil temperature or one or more other temperature signals. ECM 80 may also determine that an increased amount of pilot fuel is desirable when IMAT is below a predetermined temperature, or based on a look-up table or map that stores one or more relationships between IMAT (or other temperatures), desired quantities of pilot fuel, and/or desired pressure differentials.

A step 410 may include injecting the first fuel and the second fuel with quantities that are adjusted based on the changed pressure differential between these two fuels. In an example where the pressure of the pilot fuel is increased, a greater amount of fuel may be received within nozzle 44 via pilot fuel openings 42. Conversely, when step 408 includes reducing the pressure differential between the first fuel and the second fuel, this may result in the injection of a reduced quantity of the pilot fuel.

In some situations, method 400 may include modifying step 410 such that only the first fuel is injected by injecting pilot fuel to both passage 64 and pilot fuel connection 18. This may be performed based on a determination by ECM 80 that a "limp-home" mode or reduced-power mode is desirable. Once ECM 80 enters a limp-home mode, the output of the engine may be reduced while generating sufficient power to, in the case of a mobile machine, propel the machine from a first location to a second location. This mode may be entered when ECM 80 identifies a fault associated with the primary fuel (e.g., a fault in one or more pressure pumps 78, or the absence of primary fuel in a fuel storage) or when use of primary fuel is not desired (e.g., due to a low quantity of this fuel being available and/or in response to a request from an operator of the engine to discontinue use of the primary fuel). The limp-home mode may be enabled via an electronically-controlled valve (not shown) connected between pump 74 and pump 78, for example, that allows pilot fuel from a pilot fuel storage to be supplied simultaneously to both pumps 74 and 78.

While steps 402, 404, 406, 408, and 410 were described in an exemplary order, as understood, one or more of these steps may be performed in a different sequence and/or in a partially or fully-overlapping period of time. One or more sequential fuel injections may omit one or more of these steps. Method 400 may be performed continuously or intermittently during operation of an internal combustion engine.

The disclosed system and method may enable utilization of a single fuel injector to inject two different types of liquid fuels. These fuels may be injected in a stratified (e.g., sequential) manner, such that a pilot fuel is injected prior to a primary fuel. This may enable more complete combustion of the primary fuel, improved engine performance, and reduced greenhouse gas emissions. In some aspects, control of pilot fuel via pressurization of the fuel may enable improved control over the amount of pilot fuel metered into a tip of the fuel injector.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A multi-fuel injector, comprising:

a primary fuel inlet configured to receive a liquid primary fuel;

a pilot fuel inlet configured to receive a liquid pilot fuel that is a different fuel than the primary fuel;

a spill valve in fluid communication with the primary fuel inlet;

a control valve configured to control a pressure of fluid within a hydraulic control chamber; and an injection valve abutting the hydraulic control chamber, the injection valve being configured to move to an injection position to inject both the primary fuel and the pilot fuel.

2. The multi-fuel injector of claim 1, wherein the injection valve includes an injection valve member having a hollow interior configured to receive the pilot fuel.

3. The multi-fuel injector of claim 2, wherein the hydraulic control chamber is in fluid communication with the hollow interior of the injection valve.

4. The multi-fuel injector of claim 3, wherein the injection valve includes at least one opening at a distal end portion of the hollow interior of the injection valve.

5. The multi-fuel injector of claim 1, wherein the hydraulic control chamber is in fluid communication with the pilot fuel inlet.

6. The multi-fuel injector of claim 5, wherein the control valve is configured to block a flow of pilot fuel from the pilot fuel inlet to the hydraulic control chamber when in a first position.

7. The multi-fuel injector of claim 6, wherein the control valve is configured to permit the flow of pilot fuel from the pilot fuel inlet to the hydraulic control chamber when in a second position.

8. A fuel injection system, comprising:

a fuel injector configured to inject multiple liquid fuels from a single injection nozzle;

a fuel supply system configured to supply a first fuel at a first pressure and a second fuel at a second pressure; and an electronic control module configured to:

set the first pressure, set the second pressure, and adjust at least one of the first pressure or the second pressure to change a quantity of the first fuel injected by the injection nozzle.

9. The fuel injection system of claim 8, wherein the first fuel is a pilot fuel injected prior to the second fuel in the same injection event.

10. The fuel injection system of claim 9, wherein the pilot fuel has a higher cetane number as compared to the second fuel .

11. The fuel injection system of claim 8, wherein the electronic control module is further configured to increase the first pressure and/or decrease the second pressure to increase an amount of the first fuel present within the injection nozzle prior to injection of the first fuel.

12. The fuel injection system of claim 8, wherein the fuel supply system includes a primary fuel fitting connected to a body of the fuel injector and a pilot fuel connection formed on the body of the fuel injector.

13. A fuel injection method, comprising:

setting a first pressure for a first liquid fuel;

setting a second pressure for a second liquid fuel, the first liquid fuel being different than the second liquid fuel;

supplying the first liquid fuel to a fuel injector at the first pressure;

supplying the second liquid fuel to the fuel injector at the second pressure;

injecting the first liquid fuel and the second liquid fuel in a first injection; and adjusting at least one of the first pressure and the second pressure to modify a quantity of first liquid fuel injected in a second injection.

14. The fuel injection method of claim 13, wherein the first liquid fuel and the second liquid fuel are injected from at least one shared orifice in a nozzle of the fuel injector.

15. The fuel injection method of claim 14, wherein the first liquid fuel is injected via a hollow injection valve member that supplies the first liquid fuel to an interior of the nozzle.

16. The fuel injection method of claim 13, wherein adjusting at least one of the first pressure and the second pressure includes increasing a difference between the first pressure and the second pressure based on at least one of a cold start condition or a low intake air temperature condition.

17. The fuel injection method of claim 16, wherein the second liquid fuel includes an alcohol.

18. The fuel injection method of claim 13, wherein injection occurs when an injection valve member moves away from an orifice in a nozzle of the fuel injector, a movement of the injection valve member being permitted or blocked with a control chamber.

19. The fuel injection method of claim 18, wherein the control chamber is in fluid communication with a hollow interior of the injection valve member.

20. The fuel injection method of claim 19, wherein the fuel injector includes a first fluid path for the first liquid fuel and a second fluid path for the second liquid fuel, the first fluid path and the second fluid path being isolated from each other until the first fluid path and the second fluid path connect to each other within the nozzle.

* * * * *